US012303738B2

(12) United States Patent
Wyncott

(10) Patent No.: US 12,303,738 B2
(45) Date of Patent: May 20, 2025

(54) DUMBBELL SAFETY HOOK

(71) Applicant: Fitness Friends, LLC, Grayslake, IL (US)

(72) Inventor: Ronald Wyncott, Grayslake, IL (US)

(73) Assignee: Fitness Friends, LLC, Grayslake, IL (US)

( * ) Notice: Subject to any disclaimer, the term of this patent is extended or adjusted under 35 U.S.C. 154(b) by 0 days.

(21) Appl. No.: 18/893,535

(22) Filed: Sep. 23, 2024

(65) Prior Publication Data

US 2025/0108248 A1 Apr. 3, 2025

Related U.S. Application Data

(60) Provisional application No. 63/586,697, filed on Sep. 29, 2023.

(51) Int. Cl.
*A63B 21/16* (2006.01)
*A63B 21/072* (2006.01)

(52) U.S. Cl.
CPC ..... *A63B 21/16* (2013.01); *A63B 21/0724* (2013.01); *A63B 21/0726* (2013.01)

(58) Field of Classification Search
CPC ..... A63B 21/16; A63B 21/072–0783
See application file for complete search history.

(56) References Cited

U.S. PATENT DOCUMENTS

| | | | | |
|---|---|---|---|---|
| 6,436,016 | B1 | 8/2002 | Valentino | |
| 6,715,728 | B2 | 4/2004 | Nielsen | |
| 2002/0190177 | A1* | 12/2002 | Nielsen | A63B 21/4009 248/339 |
| 2006/0261815 | A1* | 11/2006 | Martin | G01C 15/12 324/330 |
| 2015/0031508 | A1* | 1/2015 | Goldberg | A63B 21/4035 482/106 |
| 2016/0263461 | A1* | 9/2016 | Kay | A63B 21/153 |
| 2017/0136284 | A1* | 5/2017 | Meeker | A63B 21/072 |
| 2023/0271051 | A1* | 8/2023 | Valbuena | A63B 21/0724 482/104 |
| 2024/0335694 | A1* | 10/2024 | Richard | A63B 21/0552 |

* cited by examiner

*Primary Examiner* — Loan B Jimenez
*Assistant Examiner* — Catrina A Letterman
(74) *Attorney, Agent, or Firm* — Crowell & Moring LLP

(57) ABSTRACT

A safety hook is provided. The safety hook is configured to reversibly support a handle of an object horizontally above the ground. The safety hook includes a bracket, a shank end of a flat hook extending from a top bracket surface, a first J-hook shank end of a first J-hook extending from a bottom bracket surface, and a second J-hook shank end of a second J-hook extending from the bottom bracket surface and spaced apart horizontally from the first J-hook. A method of using a safety hook is further provided.

18 Claims, 9 Drawing Sheets

DUMBBELL SAFETY HOOK

CROSS-REFERENCE TO RELATED APPLICATIONS

The present application claims the benefit of U.S. Provisional Application No. 63/586,697, filed Sep. 29, 2023, the entirety of which is incorporated by reference herein for all purposes.

TECHNICAL FIELD

The present disclosure relates to exercise equipment.

BACKGROUND

Weightlifting is a popular form of physical exercise to build strength and stamina, increase metabolism, and reduce the risk of osteoporosis. Many athletes rely on weightlifting to increase their performances. Many doctors prescribe weightlifting for their patients to allow the patients to regain strength, stamina, and coordination after injury and/or surgery.

Often, weightlifting exercises require the use of a weight bench and a rack, such as a flat, incline, decline, or military press bench. Dumbbells may be used with the bench and rack to perform various exercises, but each of the dumbbells required for performing the exercises may be heavier than a weight that can safely be lifted from the floor when the weightlifter is in position to perform an exercise on a weight bench. Consequently, the weightlifter must wait for a spotter to hand the weightlifter the dumbbells. Even if the weightlifter can raise the dumbbells from the floor while lying prone, the weightlifter may have to bend awkwardly from the bench in order to raise the dumbbells to start exercising and to return the dumbbells to the floor at the end of the exercise. The awkward bends increase the risk of injury when lifting weights, because the weightlifter may easily pull, strain, or tear a muscle, cause a back injury, or smash one or more fingers.

Conventional supporting devices have provided elevation of the dumbbells from the floor, such that the weightlifter does not have to bend awkwardly to reach the dumbbells. However, the devices are designed such that the dumbbells remain in the devices while the weightlifter uses the dumbbells such that the weightlifter is required to awkwardly raise not only the dumbbells, but also the unwieldly devices. Alternatively, the devices may not provide for the dumbbells to rest horizontally such that the weightlifter can grasp the dumbbells safely. Further, devices may require that standard dumbbells be modified before the dumbbells may be used with the devices.

Thus, there is a need for a dumbbell support device in which standard dumbbells may be elevated and rest horizontally without dumbbell modification, from which the dumbbells may be easily removed prior to exercise movement and to which the dumbbells may be easily returned following exercise movement.

SUMMARY

In an example, the present disclosure provides a safety hook, including: a bracket, including a top bracket surface and a bottom bracket surface; a hook, including a shank end, a shank, a point, and a point end, the hook extending in a first direction from the top bracket surface at the shank end; a first J-hook, the first J-hook including a first J-hook shank end, a first J-hook shank, a first J-hook point, and a first J-hook point end, the first J-hook extending in a second direction from the bottom bracket surface at the first J-hook shank end, the second direction opposite the first direction; and a second J-hook, the second J-hook including a second J-hook shank end, a second J-hook shank, a second J-hook point, and a second J-hook point end, the second J-hook extending in the second direction from the bottom bracket surface at the second J-hook shank end, the second J-hook spaced apart horizontally from the first J-hook along the bottom bracket surface. The hook is configured to be removably secured to a horizontal rod. The first J-hook bend and the second J-hook bend are configured to support a handle of an object horizontally above the ground.

In another example, the present disclosure provides a method of using a safety hook, including: securing a hook of the safety hook to a horizontal rod, a shank end of the hook extending from a top bracket surface of a bracket of the safety hoot, the safety hook hanging downward from the horizontal rod; and placing a handle of an object in contact with each of a first J-hook of the safety hook and a second J-hook of the safety hook, a first J-hook shank end and a second J-hook shank end extending from a bottom bracket surface of the bracket, the second J-hook spaced apart horizontally from the first J-hook, the handle horizontally supported above the ground by the safety hook.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

In order that the present disclosure may be well understood, there will now be described various forms thereof, given by way of example, reference being made to the accompanying drawings. The components 'in the figures are not necessarily to scale.

Figure 1:
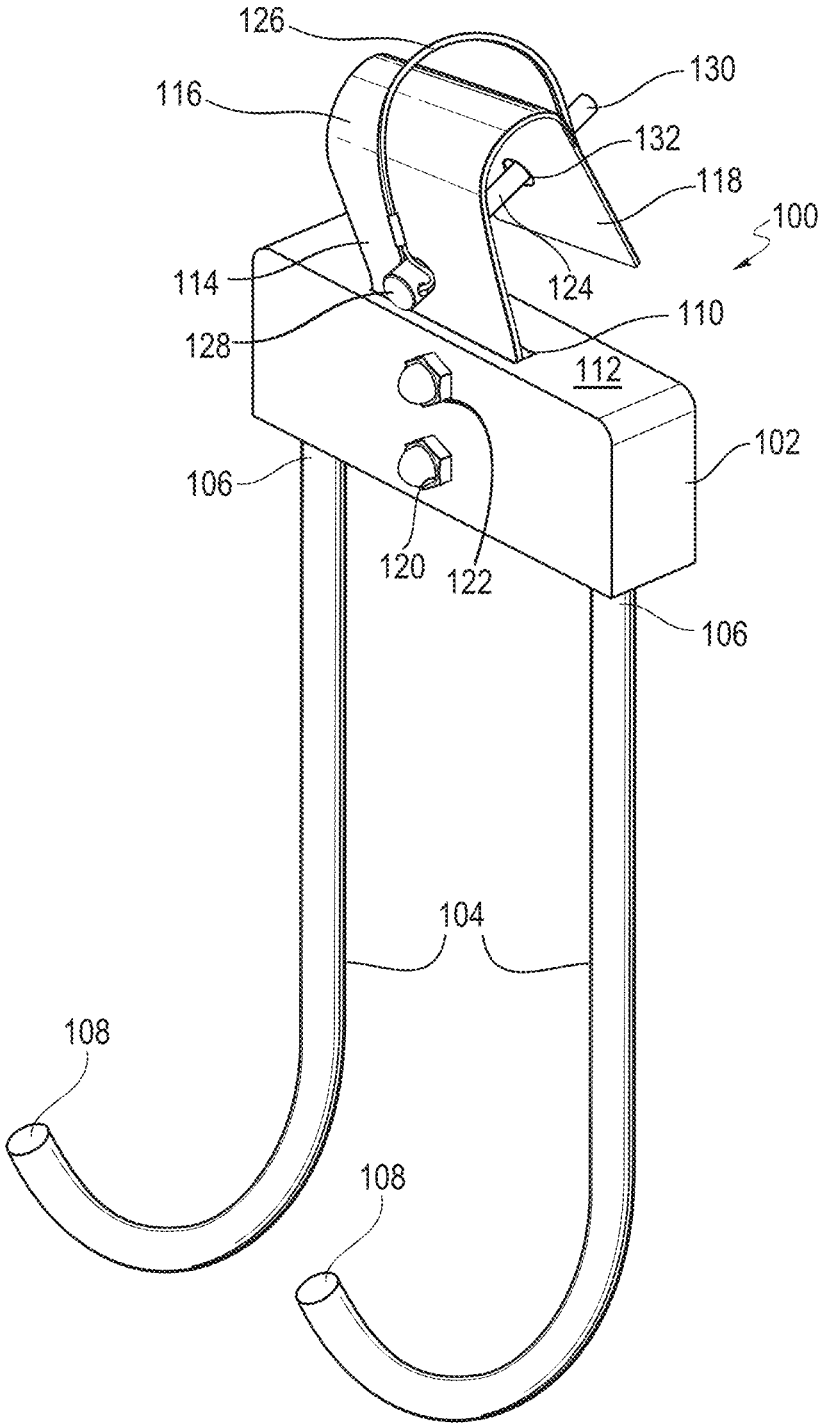
FIG. 1 illustrates a perspective view of an example of a dumbbell safety hook according to the principles of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses.

The uses of the terms "a" and "an" and "the" and similar referents in the context of describing the present disclosure (especially in the context of the following claims) are to be construed to cover both the singular and the plural, unless otherwise indicated herein or clearly contradicted by context. The use of the term "plurality of" is defined by the Applicant in the broadest sense, superseding any other implied definitions or limitations hereinbefore or hereinafter unless expressly asserted by Applicant to the contrary, to mean a quantity of more than one. All methods described herein may be performed in any suitable order unless otherwise indicated herein by context.

As will be understood by one skilled in the art, for any and all purposes, all ranges recited herein also encompass any and all possible sub-ranges and combinations of sub-ranges thereof, as well as the individual values making up the range, particularly integer values. It is therefore understood that each unit between two particular units is also disclosed. For example, if "10 to 15" is disclosed, then 11, 12, 13, and 14 are also disclosed, individually, and as part of a range. A recited range (for example, weight percentages or carbon groups) includes each specific value, integer, decimal, or identity within the range. Any listed range may be easily recognized as sufficiently describing and enabling the same range being broken down into at least equal halves, thirds, quarters, fifths, or tenths. As will also be understood by one skilled in the art, all language such as "up to," "at least," "greater than," "less than," "more than," "or more," and the like, include the number recited and such terms refer to ranges that may be subsequently broken down into sub-ranges. In the same manner, all ratios recited herein also include all sub-ratios falling within the broader ratio. Accordingly, specific values recited for radicals, substituents, and ranges are for illustration only; the specific values do not exclude other defined values or other values within defined ranges for radicals and substituents. It will be further understood that the endpoints of each of the ranges are significant both in relation to the other endpoint, and independently of the other endpoint.

As used herein, the terms "comprise(s)," "include(s)," "having," "has," "may," "contain(s)," and variants thereof, are intended to be open-ended transitional phrases, terms, or words that do not preclude the possibility of additional acts or structures. The present description also contemplates other examples "comprising," "consisting of," and "consisting essentially of," the examples or elements presented herein, whether explicitly set forth or not.

In describing elements of the present disclosure, the terms "$1^{st}$," "$2^{nd}$," "first," "second," "A," "B," "(a)," "(b)," and the like may be used herein. These terms are only used to distinguish one element from another element, but do not limit the corresponding elements irrespective of the nature or order of the corresponding elements.

Unless otherwise defined, all terms used herein, including technical or scientific terms, have the same meanings as those generally understood by those skilled in the art to which the present disclosure pertains. Such terms as those defined in a generally used dictionary are to be interpreted as having meanings equal to the contextual meanings in the relevant field of art.

As used herein, the term "about," when used in the context of a numerical value or range set forth means a variation of ±15%, or less, of the numerical value. For example, a value differing by ±15%, ±14%, ±10%, or ±5%, among others, would satisfy the definition of "about," unless more narrowly defined in particular instances.

The terms "brazing," "brazed," and "braze," unless otherwise defined, refer to a metal-joining process known in the art in which two more surfaces that are free of oxides are joined together by melting and flowing a filler metal into the joint, the filler metal having a lower melting point than the adjoining two or more surfaces. The process of "brazing" does not involve melting the two or more surfaces together. Further, the process of "brazing" requires that the two or more surfaces are much more closely fitted surfaces than in soldering. During the process of "brazing," the filler metal flows into the gap between the closely fitting two or more surfaces by capillary action.

The terms "welding," "welded," and "weld," unless otherwise defined, refer to a metal-joining process known in the art in which two or more surfaces are melted, joined together, and allowed to cool once together, causing fusion. In addition to melting the base melting surfaces, a filler material is often added to the joint to form a pool of molten material that cools to form a joint that may be stronger than the base material. Pressure may also be used in conjunction with heat to produce a weld.

The terms "cast" and "casting," as used herein, unless stated otherwise, refer to a process in which a liquid metal is delivered into a mold that contains a negative impression, or three-dimensional negative image, of an intended shape through a sprue, followed by cooling of the metal and mold.

The terms "injection molding" and "injection molded," as used herein, unless stated otherwise, refer to a process for producing parts by injecting molten material including metals, glasses, elastomers, confections, and thermoplastic or thermosetting polymers into a mold cavity, where the molten material cools and hardens to the configuration of the cavity. Advances in three-dimensional printing technology have resulted in photopolymers that do not melt during the injection molding of lower temperature thermoplastics being used for some simple injection molds.

The terms "three-dimensionally printing" and "three-dimensionally printed," as used herein, unless stated otherwise, refer to a variety of processes in which material is joined or solidified under computer control to create a three-dimensional object or part, which material being added together, such as liquid molecules or powder grains being fused together, typically layer by layer.

In the context of the present disclosure, a first piece is said to be "integral" to a second piece if the first and second pieces are formed as a single piece. For example, if the first and second pieces are cast as a single metal or metal alloy piece, then the first piece is integral to the second piece. However, if the first and second pieces are separately formed, and subsequently attached or fixed together, then the first piece is not integral to the second piece.

All methods described herein may be performed in any suitable order unless otherwise indicated herein or otherwise clearly contradicted by context.

Referring to FIG. 1, a perspective view of dumbbell safety hook 100 is illustrated. Dumbbell safety hook 100 includes bracket 102 including slot 110 in top bracket surface 112. A shank end of hook 116 is inserted into slot 110 in top bracket surface 112 and secured to bracket 102 by bolts 120, 122, which pass through bores in bracket 102 from a front surface to a rear surface of bracket 102, and which pass through bores in shank 114 of hook 116. Dumbbell safety hook 100 further includes two J-hooks 104 with shanks spaced apart along a length of bracket 102, the J-hooks 106 attached at the shank ends 106 to bracket 102 and extending downward from a bottom bracket surface, the bottom bracket surface opposite top bracket surface 112. A plane including point end 108, a bend, and shank end 106 of one J-hook 104 is parallel to a plane including point end 108, a bend, and shank end 106 of the other J-hook 104. In other examples, a dumbbell safety hook may have more than two J-hooks 104 evenly or unevenly spaced apart horizontally, with a plane including point end 108, a bend, and shank end 106 of each J-hook 104 parallel to all other planes.

Figure 4:
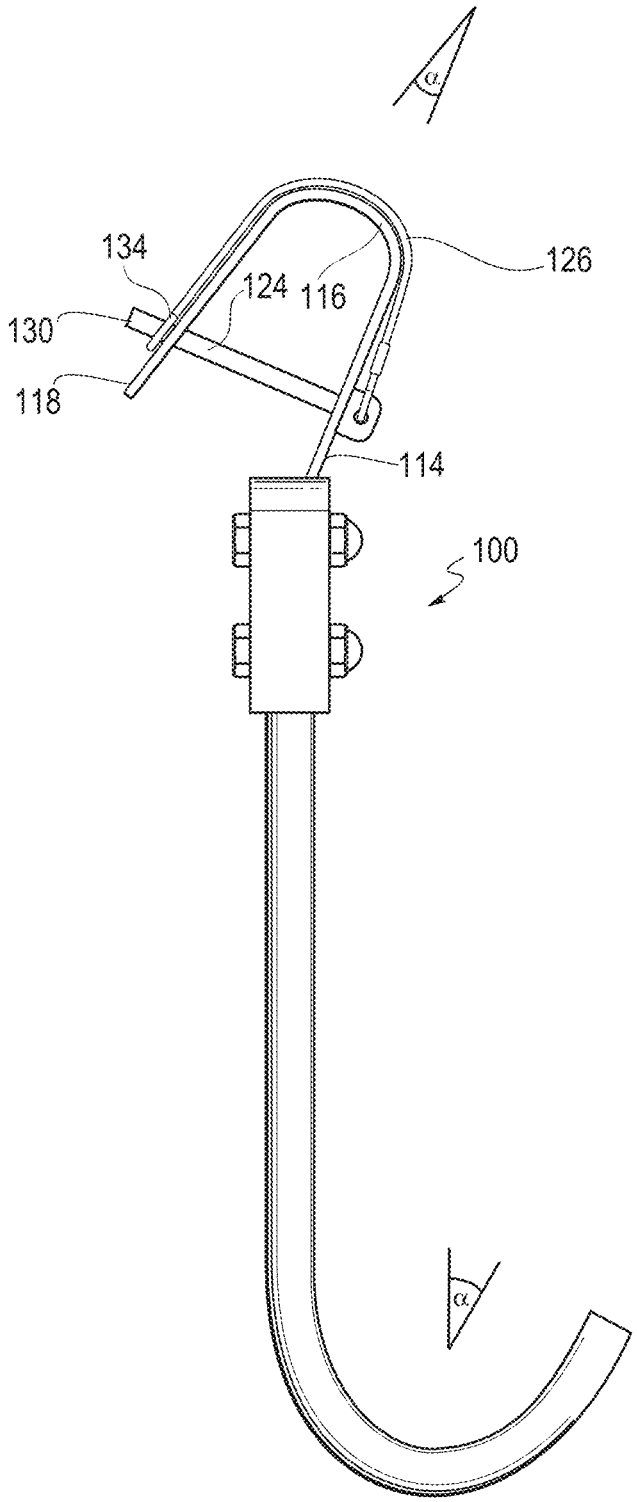
FIG. 4 illustrates a side view of the example of a dumbbell safety hook illustrated in FIGS. 1-3.

Referring to FIG. 4, a side view of dumbbell safety hook 100 is illustrated, with gaps between shanks 106 and point ends 108 extending, in parallel, in a horizontal direction opposite a horizontal direction in which a gap of hook 116 extends from shank 114 to distal point 118. In other examples, a gap between shanks 106 and point ends 108 may extend in a same horizontal direction as the horizontal direction in which a gap of hook 116 extends from shank 114 to distal point 118. Shank 114 and distal point 118 of hook 116 include coaxial bores 132 through which spring clip rod 124 is inserted. In certain examples, as illustrated in FIG. 4, hook 116 may be a flat hook. In certain examples, as illustrated in FIG. 4, hook 116 may include a bend between shank 114 to distal point 118 such that the gap may be a shorter or larger distance. As illustrated in FIG. 4, a bend angle α in hook 116 may be from about 20° to about 60°, including from about 22°, or from about 24°, or from about 26°, or from about 28°, or from about 30°, or from about 32°, or from about 34°, or from about 36°, or from about 38°, or from about 40°, or from about 42°, or from about 44°, or from about 46°, or from about 48°, or from about 50°, or from about 52°, or from about 54°, or from about 56°, or from about 58° to about 60°; or to about 22°, or to about 24°, or to about 26°, or to about 28°, or to about 30°, or to about 32°, or to about 34°, or to about 36°, or to about 38°, or to about 40°, or to about 42°, or to about 44°, or to about 46°, or to about 48°, or to about 50°, or to about 52°, or to about 54°, or to about 56°, or to about 58°; or a range made up from any two of the foregoing angles, including any subranges therebetween. Alternatively, a bend angel may be about 20°, or about 21°, or about 22°, or about 23°, or about 24°, or about 25°, or about 26°, or about 27°, or about 28°, or about 29°, or about 30°, or about 31°, or about 32°, or about 33°, or about 34°, or about 35°, or about 36°, or about 37°, or about 38°, or about 39°, or about 40°, or about 41°, or about 42°, or about 43°, or about 44°, or about 45°, or about 46°, or about 47°, or about 48°, or about 49°, or about 50°, or about 51°, or about 52°, or about 53°, or about 54°, or about 55°, or about 56°, or about 57°, or about 58°, or about 59°, or about 60°. In other examples, hook 116 may include internal right angles rather than a bend, such that distal point 118 is separated from shank 114 by a gap, and distal point 118 extends in a direction opposite shank 114 and towards top bracket surface 112.

Figure 2:
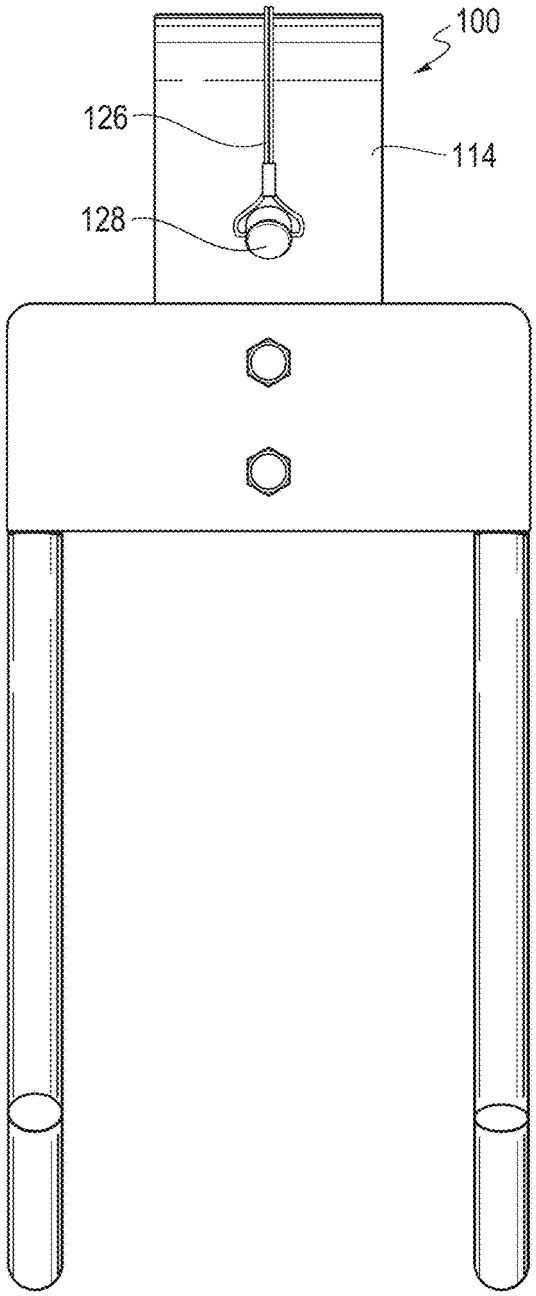
FIG. 2 illustrates a front view of the example of a dumbbell safety hook illustrated in FIG. 1.
Figure 3:
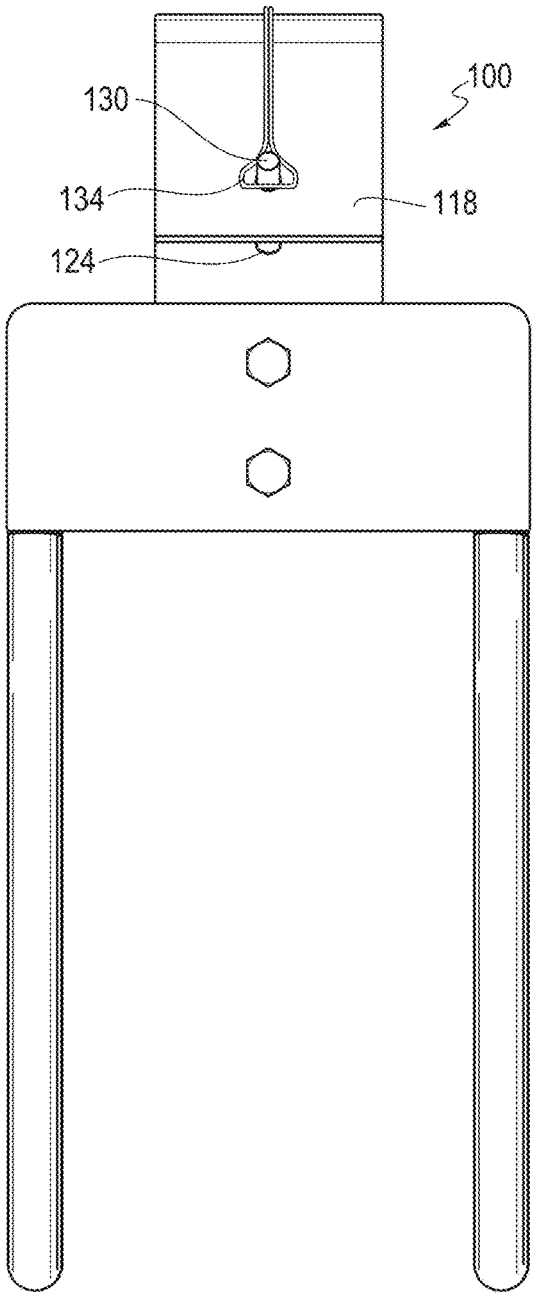
FIG. 3 illustrates a rear view of the example of a dumbbell safety hook illustrated in FIGS. 1 and 2.

Referring to FIG. 2, a front view of dumbbell safety hook 100 is illustrated, in which spring clip chain 126, which may be attached to spring clip rod head 128, is wrapped over an upper surface of hook 116 and reversibly affixed to distal rod end 130. Referring to FIG. 3, a rear view of dumbbell safety hook 100 is illustrated, in which spring clip chain 126 includes loop 134 at the distal end of spring clip chain 126. Loop 134 may encircle distal rod end 130 to secure spring clip chain 126 and spring clip rod 124 around a straight bar in contact with the bend of hook 116.

In certain examples, J-hooks 106 may each have a bend angle α between point end 108 and shank 104 of from about 20° to about 60°, including from about 22°, or from about 24°, or from about 26°, or from about 28°, or from about 30°, or from about 32°, or from about 34°, or from about 36°, or from about 38°, or from about 40°, or from about 42°, or from about 44°, or from about 46°, or from about 48°, or from about 50°, or from about 52°, or from about 54°, or from about 56°, or from about 58° to about 60°; or to about 22°, or to about 24°, or to about 26°, or to about 28°, or to about 30°, or to about 32°, or to about 34°, or to about 36°, or to about 38°, or to about 40°, or to about 42°, or to about 44°, or to about 46°, or to about 48°, or to about 50°, or to about 52°, or to about 54°, or to about 56°, or to about 58°; or a range made up from any two of the foregoing angles, including any subranges therebetween. Alternatively, a bend angle α may be about 20°, or about 21°, or about 22°, or about 23°, or about 24°, or about 25°, or about 26°, or about 27°, or about 28°, or about 29°, or about 30°, or about 31°, or about 32°, or about 33°, or about 34°, or about 35°, or about 36°, or about 37°, or about 38°, or about 39°, or about 40°, or about 41°, or about 42°, or about 43°, or about 44°, or about 45°, or about 46°, or about 47°, or about 48°, or about 49°, or about 50°, or about 51°, or about 52°, or about 53°, or about 54°, or about 55°, or about 56°, or about 57°, or about 58°, or about 59°, or about 60°.

Stated another way, an angle of hook 116 or a J-hook may be measured by the extent to which a straight rod) (180° would have to be bent to form an acute angle between shank 114 and distal point 118, for hook 116, or to form an acute angle between a point end 108 and a shank end 104, for a J-hook. In other words, the straight rod would have to be bent in an amount of from 120° to about 160° to form an acute bend angle α of from 20° to 60°.

Figure 5:
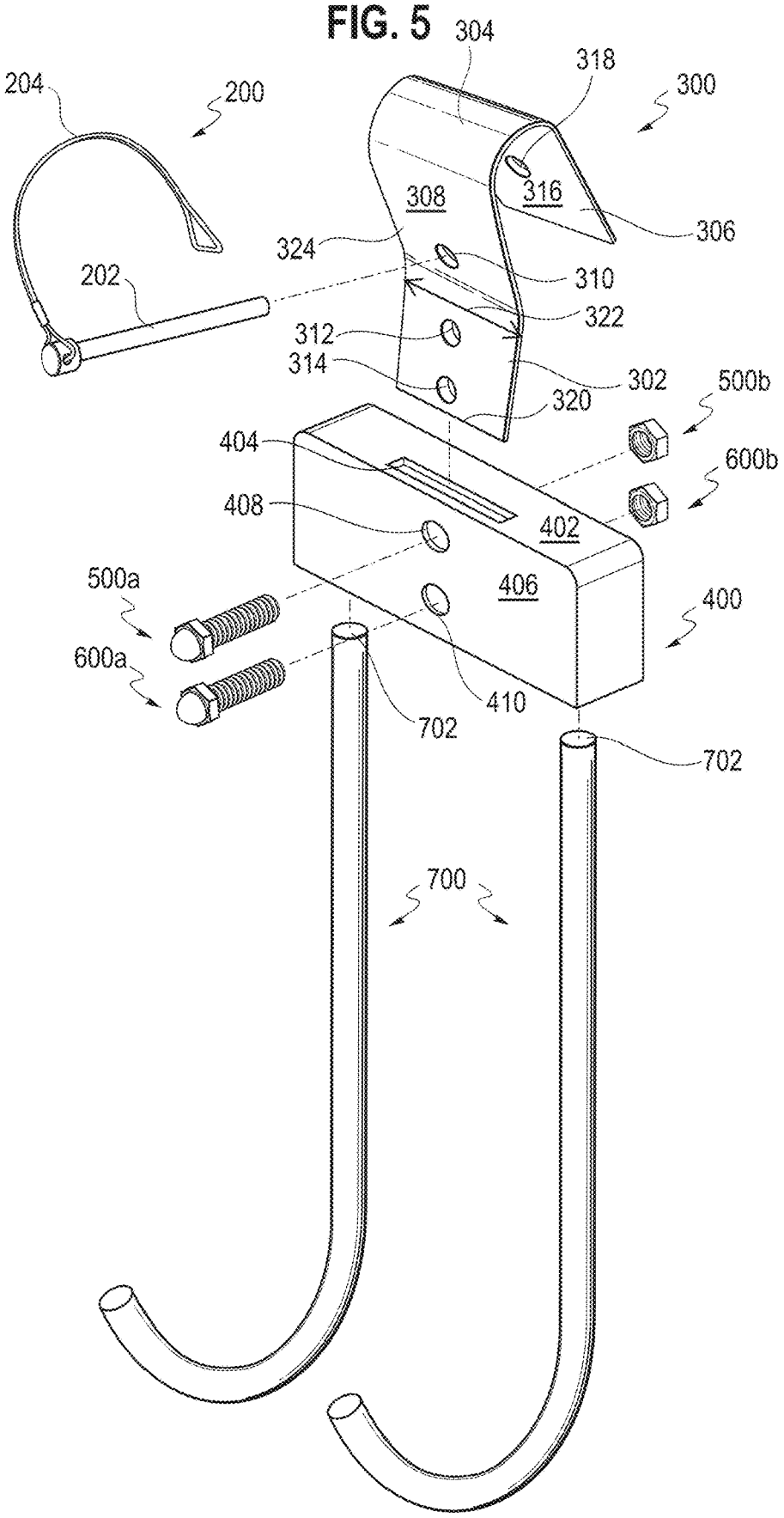
FIG. 5 illustrates an exploded view of the example of a dumbbell safety hook illustrated in FIGS. 1-4.

Referring to FIG. 5, an exploded view of dumbbell safety hook 100 is illustrated. Bracket 400 includes top bracket surface 402 including slot 404. Bracket 400 includes front surface 406 including bores 408, 410 in bracket 400 from front surface 406 to a rear surface of bracket 400. Hook 300 includes upper surface 308 and lower surface 316. Hook 300 includes proximal shank portion 302 including bores 312, 314 from upper surface 308 to lower surface 316. Bores 312, 314 align with bores 408, 410 when proximal shank end 320 is inserted into slot 404 to an appropriate depth. Distal shank portion 324 also includes bore 310 from upper surface 308 to lower surface 316. Hook 306 further includes bore 318 from upper surface 308 of point end 306 to lower surface 316. Bores 310, 318 are aligned so as to be coaxial such that spring clip rod 202 of spring clip 200 may pass through bores 310, 318, while spring clip chain 204 may be wrapped around 304 of hook 300. Proximal shank end 320 is inserted into slot 404 such that bores 312, 314 are aligned with bores 408, 410. Hook 300 is secured to bracket 400 by bolts 500*a*, 600*a*, which pass through bores 312, 314 and bores 408, 410. Around bolts 500*a*, 600*a* are tightened nuts 500*b*, 600*b*. In other examples, hook 300 may be secured to bracket 400 by brazing or welding. In still other examples, a hook may be integral to a bracket. J-hooks 700 are spaced apart horizontally and attached to a bottom surface of bracket 400 at shank ends 702 such that a plane including a point end, a bend, and shank end 702 of one J-hook 700 is parallel to a plane including a point end, a bend, and shank end 702 of the other J-hook 700. J-hooks 700 may be attached to bracket 400 at shank ends 702 by brazing or welding, or the like, or alternatively J-hooks 700 may be integral to bracket 400. In certain examples, hook 300 and J-hooks 700 may be integral to bracket 400 and cast, injection-molded, or three-dimensionally printed.

Hook 300 may have a width 322 of 1 inch (2.54 centimeters), 2 inches (5.08 centimeters), 3 inches (7.62 centimeters), or 4 inches (10.16 centimeters), or any width from about 0.5 inches (1.27 centimeters) to about 4 inches (10.16 centimeters) or more, or a range formed from any two of the foregoing widths 322, including any subranges therebetween. Hook 300 may have a thickness measured from upper surface 308 to lower surface 316 that is from about 4.0% to about 14.0% of width 322 of hook 300, including from about 4.5%, or from about 5.0%, or from about 5.5%, or from about 6.0%, or from about 6.5%, or from about 7.0%, or from about 7.5%, or from about 8.0%, or from about 8.5%, or from about 9.0%, or from about 9.5%, or from about 10.0%, or from about 10.5%, or from about 11.0%, or from about 11.5%, or from about 12.0%, or from about 12.5%, or from about 13.0%, or from about 13.5%; or to about 4.5%, or to about 5.0%, or to about 5.5%, or to about 6.0%, or to about 6.5%, or to about 7.0%, or to about 7.5%, or to about 8.0%, or to about 8.5%, or to about 9.0%, or to about 9.5%, or to about 10.0%, or to about 10.5%, or to about 11.0%, or to about 11.5%, or to about 12.0%, or to about 12.5%, or to about 13.0%, or to about 13.5%; or a range formed from any two of the foregoing percentages, including any subranges therebetween.

Figure 6:
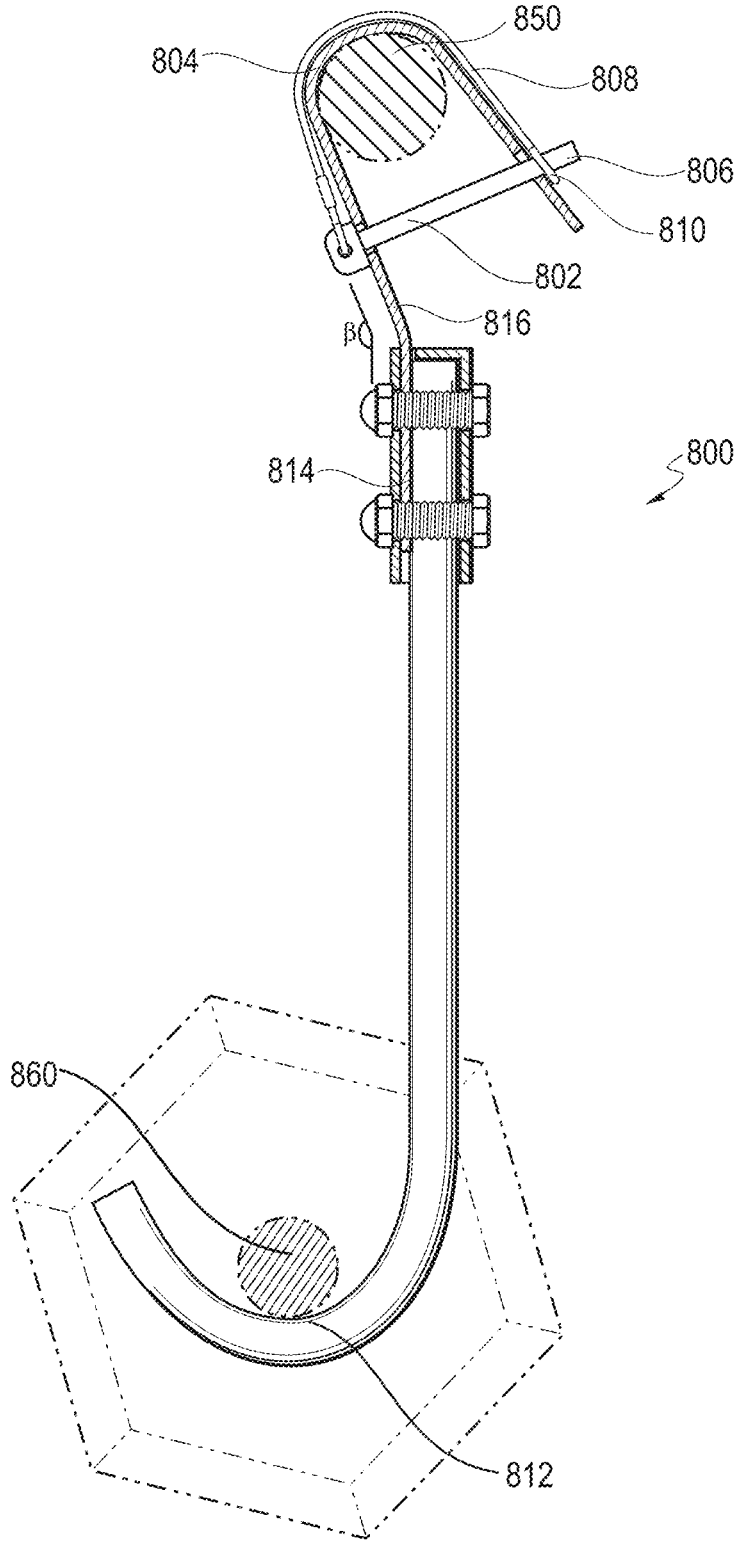
FIG. 6 illustrates a vertical cross-sectional view of another example of a dumbbell safety hook that may be reversibly secured around a circular rod, which may support a dumbbell, according to the principles of the present disclosure.

Referring to FIG. 6, a vertical cross-sectional view of dumbbell safety hook 800 that may be reversibly secured around a circular rod 850, and which may support a dumbbell 860. Hook 804 may be secured around circular rod 850 by spring clip rod 802 and spring clip chain 808, with loop 810 secured around distal end 806 of spring clip rod 802. A plane including a point end, bend 812 and a shank end of one J-hook is parallel to a plane including a point end, bend 812, and a shank end of the other J-hook such that a handle 860 of a dumbbell may rest on bend 812 of each J-hook. It has been found that a bend angle between a point end and a shank end of a J-hook is advantageously from about 20° to about 60° such that, during exercise, a handle 860 of a dumbbell supported by the J-hooks of dumbbell safety hook 800 will not slip past the point ends of the J-hooks and fall to the ground. It has been further found that a bend angle between a point end and a shank end of a J-hook is preferably from about 40° to about 50°. Most preferred is a bend angle of about 45°. Hook 804 advantageously includes proximal shank portion 814 and distal shank portion 816, distal shank portion 816 offset at a shank bend angle β relative to proximal shank portion 814. Shank bend angle β advantageously allows dumbbell safety hook 800 to hang vertically plumb down from circular rod 850. Shank bend angle β may be from about 80° to about 120°, including, for example, at least from about 82°, or from about 84°, or from about 86°, or from about 88°, or from about 90°, or from about 92°, or from about 94°, or from about 96°, or from about 98°, or from about 100°, or from about 102°, or from about 104°, or from about 106°, or from about 108°, or from about 110°, or from about 112°, or from about 114°, or from about 116°, or from about 118° to about 120°, or to about 182°, or to about 84°, or to about 86°, or to about 88°, or to about 90°, or to about 92°, or to about 94°, or to about 96°, or to about 98°, or to about 100°, or to about 102°, or to about 104°, or to about 106°, or to about 108°, or to about 110°, or to about 112°, or to about 114°, or to about 116°, or to about 120° or a range made up from any two of the foregoing angles, including any subranges therebetween. Alternatively, a shank bend angle β may be about 80°, or about 81°, or about 82°, or about 83°, or about 84°, or about 85°, or about 86°, or about 87°, or about 88°, or about 89°, or about 90°, or about 91°, or about 92°, or about 93°, or about 94°, or about 95°, or about 96°, or about 97°, or about 98°, or about 99°, or about 100°, or about 101°, or about 102°, or about 103°, or about 104°, or about 105°, or about 106°, or about 107°, or about 108°, or about 109°, or about 110°, or about 111°, or about 112°, or about 113°, or about 114°, or about 115°, or about 116°, or about 117°, or about 118°, or about 119°, or about 120°. Preferably, a shank bend angle β may be from about 95° to about 105°. Even more preferably, a shank bend angle β may be about 100°.

Figure 7:
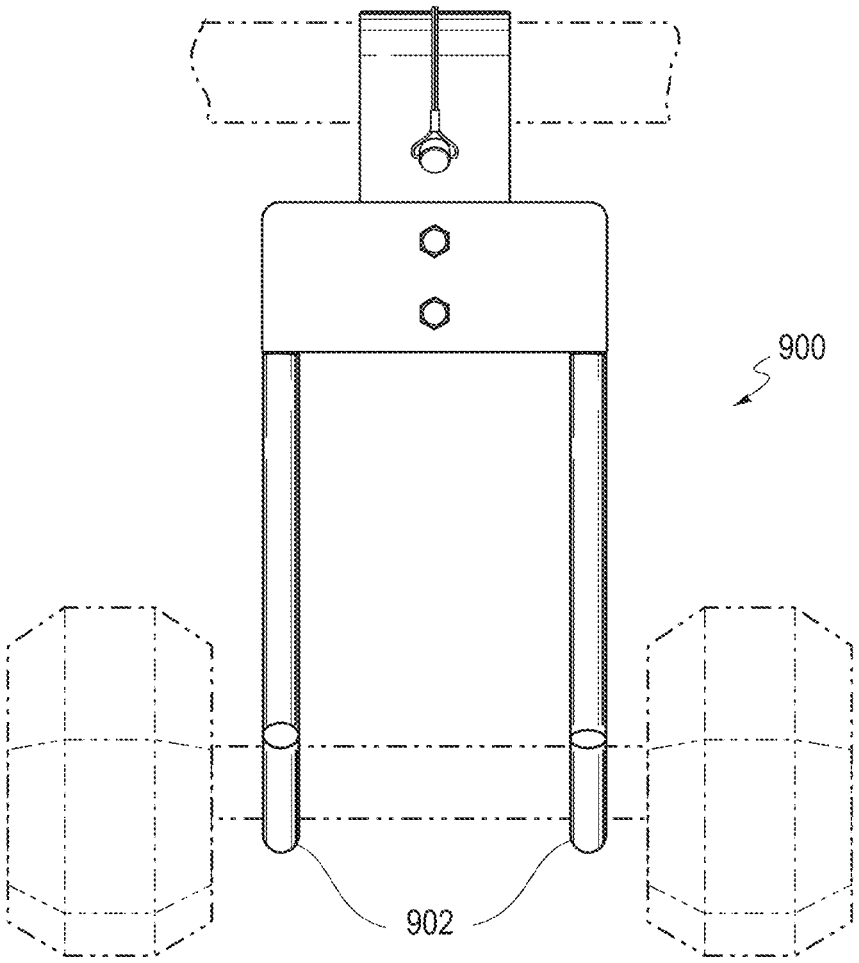
FIG. 7 illustrates a front view of the example of the dumbbell safety hook illustrated in FIG. 6.

Referring to FIG. 7, a front view of dumbbell safety hook 900 is illustrated. A dumbbell may rest in the bends of J-hooks 902 such that the dumbbell is supported by dumbbell safety hook 900 between exercises.

Figure 8:
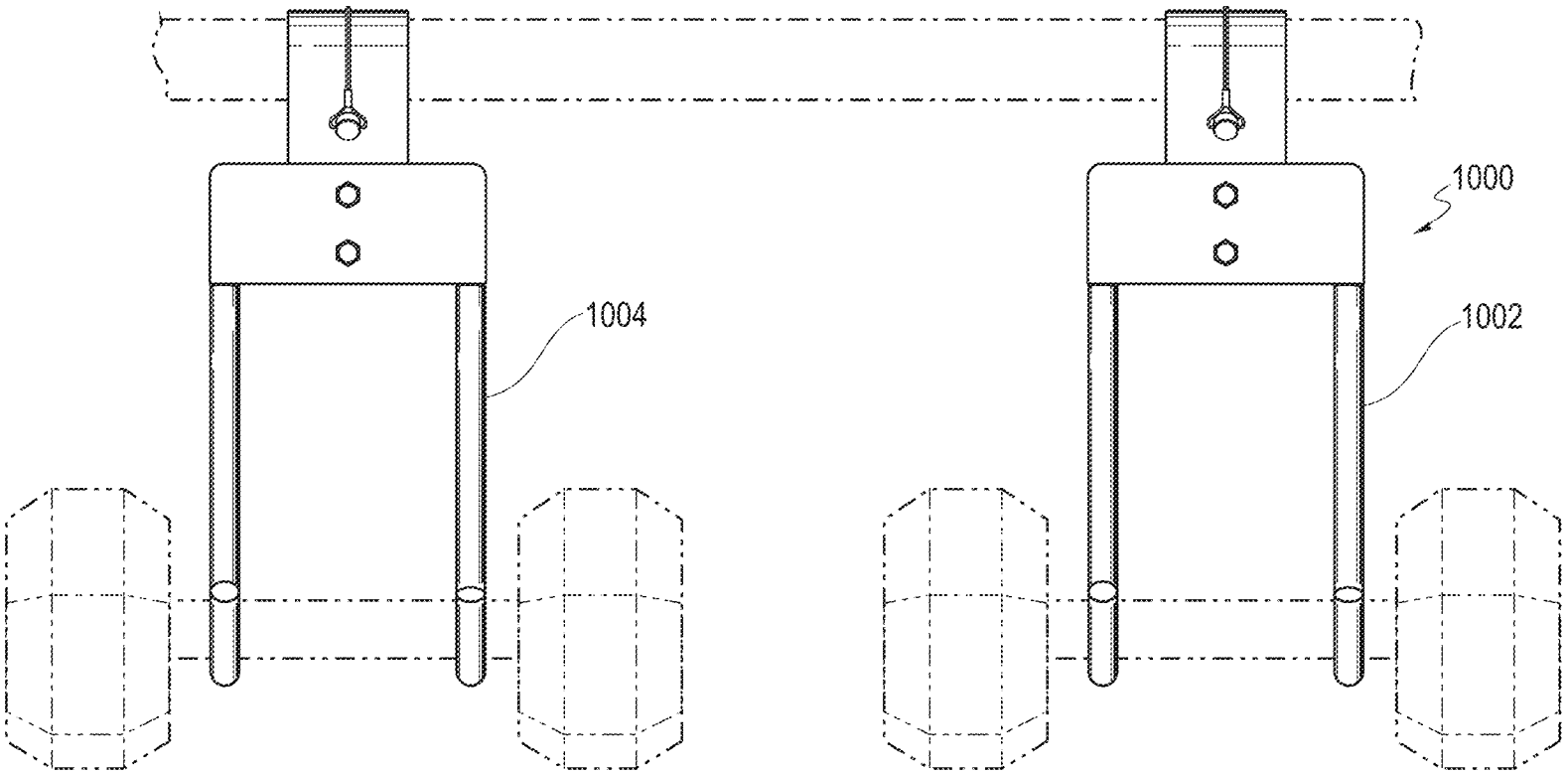
FIG. 8 illustrates a front view of an example of a pair of dumbbell safety hooks reversibly secured around a rod, each of the pair supporting a dumbbell, according to the principles of the present disclosure.
Figure 9:
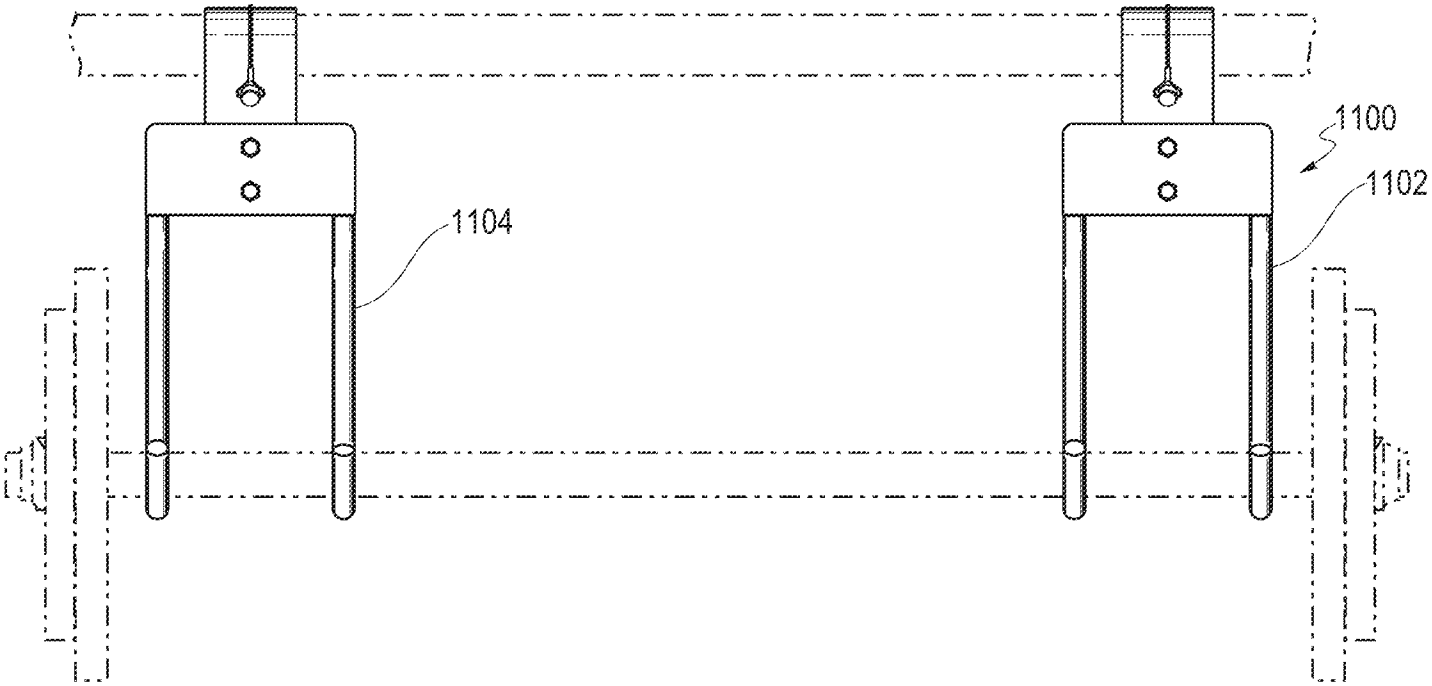
FIG. 9 illustrates a rear view of the example of the pair of dumbbell safety hooks illustrated in FIG. 9.

Referring to FIG. 8, a front view of a pair 1000 of dumbbell safety hooks 1002, 1004 reversibly secured around a metal rod, each of the dumbbell safety hooks 1002, 1004 supporting a dumbbell between exercises, is illustrated. Each of the dumbbells may be individually lifted from one of dumbbell safety hooks 1002, 1004 for use in exercise, and then replaced in the one of the dumbbell safety hooks 1002, 1004 from which the dumbbell was removed. Alternatively, both dumbbells may be simultaneously removed from the dumbbell safety hooks 1002, 1004 for use in exercise and then replaced in the dumbbell safety hooks 1002, 1004 until a subsequent use in exercise. Referring to FIG. 9, a front view of a pair 1100 of dumbbell safety hooks 1002, 1004 reversibly secured around a metal rod, the dumbbell safety hooks 1002, 1004 together supporting a single barbell between exercises, is illustrated.

Figure 10:
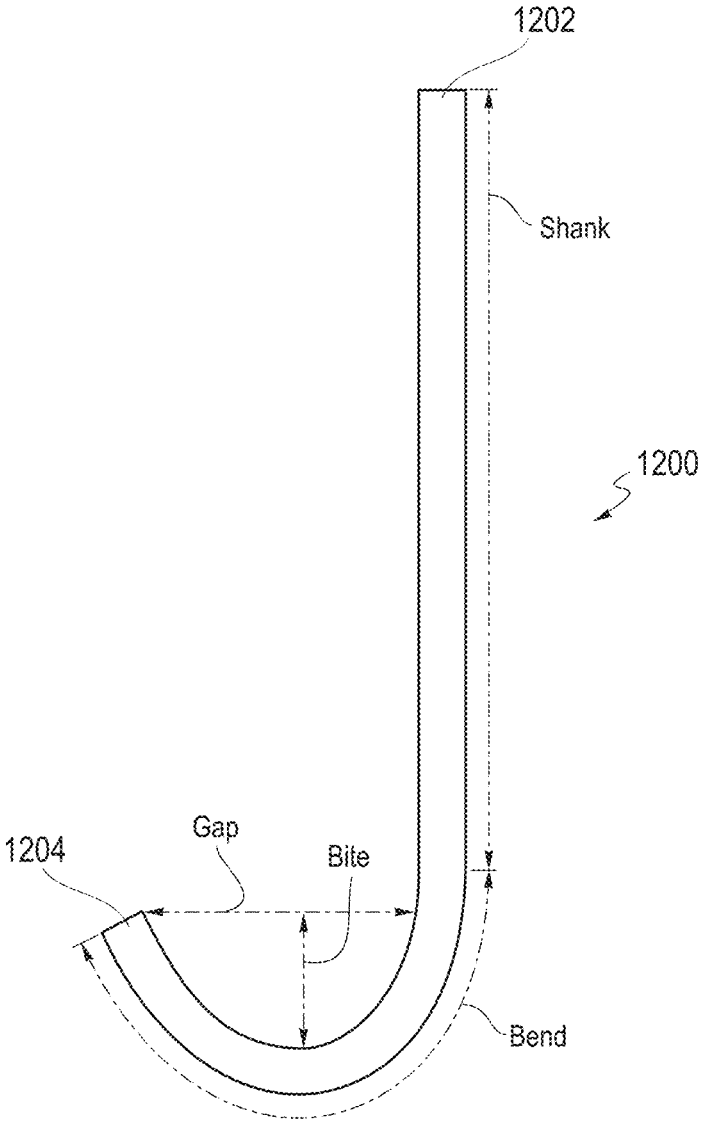
FIG. 10 illustrates a side view of an example of a J-hook.

Referring to FIG. 10, a side view of an example of a J-hook 1200 is illustrated. A side view of a flat hook may resemble the side view of J-hook 1200 illustrated in FIG. 10 such that similar referents to portions of a flat hook may be made as illustrated in FIG. 10. J-hook 1200 extends from shank end 1202 to point end 1204. By virtue of a length of a gap of J-hook 1200, the angle of the bend may be defined between shank end 1202 and point end 1204. Alternatively, the angle may be defined by the number of degrees by which an unbent, straight rod must be bent to arrive at the bend and the gap between point end 1204 and the shank.

Though not illustrated, in certain examples of dumbbell safety hooks of the present disclosure, J-hooks and/or a hook may be covered by rubber, plastic, or the like, so as to protect handles of dumbbells or barbells in contact with the J-hooks and/or so as to protect a rod in contact with the hook.

Examples of dumbbell safety hooks of the present disclosure, and elements thereof, may be fabricated from any materials such that the dumbbell safety hook is sufficient to support a standard range of dumbbell weights, such as from 0.45 kilograms to 45 kilograms, and/or two or more dumbbell safety hooks may support a range of barbell weights, such as from 0.45 kilograms to 250 kilograms.

In an example, a method of using a safety hook may include: securing a hook fo the safety hook to a horizontal end, a shank end of the hook extending from a top bracket surface of a bracket of the safety hook, the safety hook hanging vertically downward from the horizontal rod; and placing a handle of an object in contact with each of a first J-hook of the safety hook and a second J-hook of the safety hook, a first J-hook shank end and a second J-hook shank end extending from a bottom bracket surface of the bracket, the second J-hook spaced apart horizontally from the first J-hook, the handle horizontally supported above the ground by the safety hook.

In another example, a method may further include: raising the handle from contact with each of the first J-hook and the second J-hook; and replacing the handle in contact with each of the first J-hook and the second J-hook.

In another example, the securing may include reversibly attaching a spring clip to secure the horizontal rod in contact with the hook.

In another example, the object may be a dumbbell.

In another example, a method may further include: securing a second hook of a second safety hook to the horizontal rod, a second shank end of the second hook extending from a second top bracket surface of a second bracket of the second safety hook, the second safety hook hanging downward from the horizontal rod; placing a handle of a second object in contact with each of a first J-hook of the second safety hook and a second J-hook of the second safety hook, a first J-hook shank end and a second J-hook shank end extending from a second bottom bracket surface of the second bracket, the second J-hook spaced apart horizontally from the first J-hook, the handle horizontally supported above the ground by the second safety hook; wherein the second object is optionally integral to the object.

In another example, the second object may be a dumbbell.

In another example, the object and the second object may be a barbell.

While various examples have been described, it will be apparent to those of ordinary skill in the art that many more examples and implementations are possible. Accordingly, the examples described herein are not the only possible implementations.

The subject-matter of the disclosure may also relate, among others, to the following aspects:

A first aspect relates to a safety hook, comprising: a bracket, comprising a top bracket surface and a bottom bracket surface; a hook, comprising a shank end, a shank, a point, and a point end, the hook extending in a first direction from the top bracket surface at the shank end; a first J-hook, the first J-hook comprising a first J-hook shank end, a first J-hook shank, a first J-hook point, and a first J-hook point end, the first J-hook extending in a second direction from the bottom bracket surface at the first J-hook shank end, the second direction opposite the first direction; and a second J-hook, the second J-hook comprising a second J-hook shank end, a second J-hook shank, a second J-hook point, and a second J-hook point end, the second J-hook extending in the second direction from the bottom bracket surface at the second J-hook shank end, the second J-hook spaced apart horizontally from the first J-hook along the bottom bracket surface; wherein the hook is configured to be removably secured to a horizontal rod; and wherein the first J-hook bend and the second J-hook bend are configured to support a handle of an object horizontally above the ground.

A second aspect relates to the safety hook of aspect 1, wherein the hook comprises a bend between the shank and the point, and wherein a bend angle of the bend is from about 40° to about 50°.

A third aspect relates to the safety hook of any preceding aspect, wherein the first J-hook comprises a first J-hook bend between the first J-hook shank and the first J-hook point, wherein the second J-hook comprises a second J-hook bend between the second J-hook shank and the second J-hook point, and wherein a J-hook bend angle of the first J-hook bend and the second J-hook bend is from about 40° to about 50°.

A fourth aspect relates to the safety hook of aspect 3, wherein the J-hook bend angle of the first J-hook bend and the second J-hook bend is about 45°.

A fifth aspect relates to the safety hook of any preceding aspect, wherein the shank has a first bore extending therethrough and the point has a second bore extending therethrough, the second bore coaxial with the first bore.

A sixth aspect relates to the safety hook of aspect 5, further comprising a spring clip, the spring clip comprising: a spring clip rod, the spring clip rod comprising a rod distal end configured to reversibly extend through the first bore and the second bore; and a spring clip chain, the spring clip chain comprising a chain distal end configured to reversibly engage the rod distal end, the spring clip chain disposed around the bend; wherein the spring clip is configured to reversibly secure the bend around the horizontal rod.

A seventh aspect relates to the safety hook of any preceding aspect, further comprising a spring clip, the spring clip configured to reversibly secure the hook around the horizontal rod.

An eighth aspect relates to the safety hook of any preceding aspect, wherein the object is a dumbbell.

A ninth aspect relates to the safety hook of any preceding aspect, wherein a hook gap extends from the shank to the point end in a horizontal direction opposite a first J-hook gap extending from the first J-hook shank to the first J-hook point end, and opposite a second J-hook gap extending from the second J-hook shank to the second J-hook point end.

A tenth aspect relates to the safety hook of any preceding aspect, wherein the shank comprises a proximal shank portion and a distal shank portion, the distal shank portion bent relative to the proximal shank portion such that an angle between the distal shank portion and the proximal shank portion is from about 95° to about 105°.

An eleventh aspect relates to the safety hook of any preceding aspect, wherein a first J-hook gap extending from the first J-hook shank to the first J-hook point end is parallel to a second J-hook gap extending from the second J-hook shank to the second J-hook point end.

A twelfth aspect relates to an array of a plurality of safety hooks of any preceding aspect, wherein the object supported by each of the plurality of safety hooks is a dumbbell.

A thirteenth aspect relates to an array of a plurality of safety hooks of aspects 1 to 11, wherein the object is a barbell.

A fourteenth aspect relates to a method of using a safety hook, comprising: securing a hook of the safety hook to a horizontal rod, a shank end of the hook extending from a top bracket surface of a bracket of the safety hook, the safety hook hanging vertically downward from the horizontal rod; and placing a handle of an object in contact with each of a first J-hook of the safety hook and a second J-hook of the safety hook, a first J-hook shank end and a second J-hook shank end extending from a bottom bracket surface of the bracket, the second J-hook spaced apart horizontally from the first J-hook, the handle horizontally supported above the ground by the safety hook.

A fifteenth aspect relates to the method of aspect 14, further comprising: raising the handle from contact with each of the first J-hook and the second J-hook; and replacing the handle in contact with each of the first J-hook and the second J-hook.

A sixteenth aspect relates to the method of aspect 14 or 15, wherein the securing comprises reversibly attaching a spring clip to secure the horizontal rod in contact with the hook.

A seventeenth aspect relates to the method of aspects 14 to 16, wherein the object is a dumbbell.

An eighteenth aspect relates to the method of aspects 14 to 17, further comprising: securing a second hook of a second safety hook to the horizontal rod, a second shank end of the second hook extending from a second top bracket surface of a second bracket of the second safety hook, the second safety hook hanging downward from the horizontal rod; and placing a handle of a second object in contact with each of a first J-hook of the second safety hook and a second J-hook of the second safety hook, a first J-hook shank end and a second J-hook shank end extending from a second bottom bracket surface of the second bracket, the second J-hook spaced apart horizontally form the first J-hook, the handle horizontally supported above the ground by the second safety hook; wherein the second object is optionally integral to the object.

A nineteenth aspect relates to the method of aspect 18, wherein the second object is a dumbbell.

A twentieth aspect relates to the method of aspect 18, wherein the object and the second object are a barbell.

In addition to the features mentioned in each of the independent aspects enumerated above, some examples may show, alone or in combination, the optional features mentioned in the dependent aspects and/or as disclosed in the description above and shown in the figures.

What is claimed is:

1. A safety hook, comprising:

a bracket, comprising a top bracket surface and a bottom bracket surface;

a hook, comprising a shank end, a shank, a bend, a point, and a point end, the hook extending in a first direction from the top bracket surface at the shank end;

a first J-hook, the first J-hook comprising a first J-hook shank end, a first J-hook shank, a first J-hook bend, a first J-hook point, and a first J-hook point end, the first J-hook extending in a second direction from the bottom bracket surface at the first J-hook shank end, the second direction opposite the first direction;

a second J-hook, the second J-hook comprising a second J-hook shank end, a second J-hook shank, a second J-hook bend, a second J-hook point, and a second J-hook point end, the second J-hook extending in the second direction from the bottom bracket surface at the second J-hook shank end, the second J-hook spaced apart horizontally from the first J-hook along the bottom bracket surface; and a spring clip;

wherein the shank has a first bore extending therethrough and the point has a second bore extending therethrough, the second bore coaxial with the first bore;

wherein the spring clip is configured to reversibly secure the hook around a horizontal rod; and wherein the first J-hook bend and the second J-hook bend are configured to support a handle of a dumbbell horizontally above the ground.

2. The safety hook of claim 1, wherein a bend angle of the bend is from about 40° to about 50°.

3. The safety hook of claim 1, wherein a J-hook bend angle of the first J-hook bend and the second J-hook bend is from about 40° to about 50°.

4. The safety hook of claim 3, wherein the J-hook bend angle of the first J-hook bend and the second J-hook bend is about 45°.

5. The safety hook of claim 1, wherein the spring clip comprises:

a spring clip rod, the spring clip rod comprising a rod distal end configured to reversibly extend through the first bore and the second bore; and a spring clip chain, the spring clip chain comprising a chain distal end configured to reversibly engage the rod distal end, the spring clip chain disposed around the bend; and wherein the spring clip is configured to reversibly secure the bend around the horizontal rod.

6. The safety hook of claim 1, wherein a hook gap extends from the shank to the point end in a horizontal direction opposite a first J-hook gap extending from the first J-hook shank to the first J-hook point end, and opposite a second J-hook gap extending from the second J-hook shank to the second J-hook point end.

7. The safety hook of claim 1, wherein the shank comprises a proximal shank portion and a distal shank portion, the distal shank portion bent relative to the proximal shank portion such that an angle between the distal shank portion and the proximal shank portion is from about 95° to about 105°.

8. The safety hook of claim 1, wherein a first J-hook gap extending from the first J-hook shank to the first J-hook point end is parallel to a second J-hook gap extending from the second J-hook shank to the second J-hook point end.

9. A method of using a safety hook, comprising:

reversibly attaching a spring clip to secure a horizontal rod in contact with a hook of the safety hook, a shank end of the hook extending from a top bracket surface of a bracket of the safety hook, the hook comprising a shank, a bend, a point, and a point end, the shank having a first bore extending therethrough and the point having a second bore extending therethrough, the second bore coaxial with the first bore, the safety hook hanging vertically downward from the horizontal rod; and placing a handle of a dumbbell or a first end of a barbell handle in contact with each of a first J-hook of the safety hook and a second J-hook of the safety hook, a first J-hook shank end and a second J-hook shank end extending from a bottom bracket surface of the bracket, the second J-hook spaced apart horizontally from the first J-hook, the handle or the first end of the barbell handle horizontally supported above the ground by the safety hook.

10. The method of claim 9, further comprising:

raising the handle from contact with each of the first J-hook and the second J-hook; and replacing the handle in contact with each of the first J-hook and the second J-hook.

11. The method of claim 9, further comprising:

reversibly attaching a second spring clip to secure the horizontal rod in contact with a second hook of a second safety hook, a second shank end of the second hook extending from a second top bracket surface of a second bracket of the second safety hook, the second hook comprising a second shank, a second bend, a second point, and a second point end, the second shank having a third bore extending therethrough and the second point having a fourth bore extending therethrough, the fourth bore coaxial with the third bore, the second safety hook hanging downward from the horizontal rod; and placing a handle of a second dumbbell or a second end of the barbell handle in contact with each of a first J-hook of the second safety hook and a second J-hook of the second safety hook, a first J-hook shank end and a second J-hook shank end extending from a second bottom bracket surface of the second bracket, the second J-hook spaced apart horizontally from the first J-hook, the handle or the second end of the barbell handle horizontally supported above the ground by the second safety hook.

12. A plurality of safety hooks, each of the plurality of safety hooks comprising:

a bracket, comprising a top bracket surface and a bottom bracket surface;

a hook, comprising a shank end, a shank, a bend, a point, and a point end, the hook extending in a first direction from the top bracket surface at the shank end;

a first J-hook, the first J-hook comprising a first J-hook shank end, a first J-hook shank, a first J-hook bend, a first J-hook point, and a first J-hook point end, the first J-hook extending in a second direction from the bottom bracket surface at the first J-hook shank end, the second direction opposite the first direction;

a second J-hook, the second J-hook comprising a second J-hook shank end, a second J-hook shank, a second J-hook bend, a second J-hook point, and a second J-hook point end, the second J-hook extending in the second direction from the bottom bracket surface at the second J-hook shank end, the second J-hook spaced apart horizontally from the first J-hook along the bottom bracket surface; and a spring clip configured to reversibly secure the hook around a horizontal rod;

wherein the shank of each of the plurality of safety hooks has a first bore extending therethrough and the point of each of the plurality of safety hooks has a second bore extending therethrough, the second bore coaxial with the first bore; and wherein the first J-hook bend and the second J-hook bend of each of the plurality of safety hooks are configured to together support a handle of a barbell horizontally above the ground and parallel to the horizontal rod.

13. The plurality of safety hooks of claim 12, wherein a bend angle of the bend of each safety hook is from about 40° to about 50°.

14. The plurality of safety hooks of claim 12, wherein a J-hook bend angle of the first J-hook bend and the second J-hook bend of each safety hook is from about 40° to about 50°.

15. The plurality of safety hooks of claim 12, wherein the spring clip of each safety hook comprises:

a spring clip rod, the spring clip rod comprising a rod distal end configured to reversibly extend through the first bore and the second bore; and a spring clip chain, the spring clip chain comprising a chain distal end configured to reversibly engage the rod distal end, the spring clip chain disposed around the bend; and wherein the spring clip is configured to reversibly secure the bend of each safety hook around the horizontal rod.

16. The plurality of safety hooks of claim 12, wherein a hook gap of each safety hook extends from the shank to the point end in a horizontal direction opposite a first J-hook gap extending from the first J-hook shank to the first J-hook point end, and opposite a second J-hook gap extending from the second J-hook shank to the second J-hook point end.

17. The plurality of safety hooks of claim 12, wherein the shank of each safety hook comprises a proximal shank portion and a distal shank portion, the distal shank portion bent relative to the proximal shank portion such that an angle between the distal shank portion and the proximal shank portion is from about 95° to about 105°.

18. The plurality of safety hooks of claim 12, wherein a first J-hook gap extending from the first J-hook shank to the first J-hook point end of each safety hook is parallel to a second J-hook gap extending from the second J-hook shank to the second J-hook point end.

* * * * *